United States Patent [19]

McGinnis

[11] Patent Number: 4,917,531

[45] Date of Patent: Apr. 17, 1990

[54] TEMPORARY DEVICE FOR USE WITH A MANHOLE SUPPORT DURING STREET REPAIRS

[76] Inventor: Robert E. McGinnis, 5712 N. 33rd St., Omaha, Nebr. 68111

[21] Appl. No.: 363,637

[22] Filed: Jun. 8, 1989

[51] Int. Cl.[4] ..... E02D 29/14

[52] U.S. Cl. ..... 404/26; 404/32; 404/35; 52/20

[58] Field of Search ..... 404/26, 25, 32, 35, 404/40; 238/8; 52/19, 20; 14/69.5, 71.1

[56] References Cited

U.S. PATENT DOCUMENTS

| | | | |
|---|---|---|---|
| 3,237,538 | 3/1966 | McPheeters et al. | 404/26 |
| 3,426,659 | 2/1969 | Clarke et al. | 404/25 |
| 3,968,600 | 7/1976 | Bowman | 52/19 |
| 4,187,647 | 2/1980 | Hall et al. | 52/20 |
| 4,466,219 | 8/1984 | Campolito | 52/20 |
| 4,475,845 | 10/1984 | Odill et al. | 52/20 X |
| 4,746,243 | 5/1988 | Perry | 404/35 X |
| 4,808,025 | 2/1989 | McGinnis | 404/26 |

*Primary Examiner*—Stephen J. Novosad

*Attorney, Agent, or Firm*—Zarley, McKee, Thomte, Voorhees & Sease

[57] ABSTRACT

A temporary device is used for street repair work to provide a ramp between the ground roadway surface and the upper end of such structures as manhole supports, etc. The device of this invention is removably secured to the roadway and the manhole cover by a plurality of clips having a first portion embedded within the ramp and a second portion which operably engages the manhole support and manhole cover.

15 Claims, 2 Drawing Sheets

TEMPORARY DEVICE FOR USE WITH A MANHOLE SUPPORT DURING STREET REPAIRS

BACKGROUND OF THE INVENTION

Occasionally, it is necessary to resurface city streets. In some cases, a portion of the old street or roadway is ground away to provide a suitable base for the new surface. When a portion of the old street has been removed, manhole covers and their supports, present in the street, protrude upwardly from the ground surface thereby creating a hazard to vehicles. To protect the vehicles from damage which could occur if the vehicle strikes the manhole support, barricades are normally erected around the supports thereby creating traffic bottlenecks.

When the street has been resurfaced, the resurfacing material, which is usually asphalt, covers the manhole supports and manholes. Workmen then chip away the asphalt material from the manhole supports thereby creating holes in the new surface until workmen are able to repair the same. In such a case, barricades are normally also erected around the manhole until the workmen have had an opportunity to repair the surface.

The applicant in U.S. Pat. No. 4,808,025 addressed these above-mentioned problems. While the invention, which was the subject of the '025 patent, has worked quite well for its intended purpose, the applicant has found that in some instances it is not desirable to use stakes to temporarily secure the device in place. In some cases, the area adjacent the manhole support is not sufficiently stable to permit the stakes to firmly secure the device. Another problem associated with the use of stakes is that a special tool must be used to remove the stake. Additionally, the use of stakes requires that the appropriate hole be drilled into the road surface. Drilling of the hole into road surface requires the use of proper drilling equipment which utilizes expensive carbide or diamond-tipped drill bits. Furthermore, the use of stakes requires more labor and effort to secure and/or remove the device and thus, increasing labor costs.

The applicant has also found that while the device is temporarily secured into position, the device does not work well in those cases where the device need only be secured for a very short duration and/or must be repetitively removed so as to permit further work to be done in the area adjacent the manhole support.

It is therefore a principal object of this invention to provide a temporary device which may be used with manhole supports during street repair operations which does not require the use of stakes to temporarily secure the same to position.

Another object of this invention is to provide a temporary device which may be used with manhole supports during street repair operations to eliminate the necessity of erecting barricades around the same.

An additional object of the present invention is to provide a temporary device which may be firmly secured in place yet readily removable without requiring the use of any special tools.

A further objective of the invention is to provide a temporary device which may be used with a manhole support comprising a resilient ramp positioned around the manhole support to provide cushion contact between a vehicle wheel and the manhole support.

Yet another object of the invention is to provide a temporary device which may be used in connection with manhole supports during street repair operations including means for securing the device to the roadway.

Yet another object of the invention is to provide a temporary device of the type described which is economical of manufacture, durable in use and refined in appearance.

These and other objects will be apparent to those skilled in the art.

SUMMARY OF THE INVENTION

The cushioning device of this invention is designed to be used during street repair operations to prevent damage to a vehicle should the vehicle come into contact with the manhole support. When a roadway surface has been ground down, the manhole cover is removed and the device of the present invention is positioned around the manhole support and secured to the roadway to prevent movement thereof. The manhole cover is then returned to its proper supporting structure. The device comprises a flat resilient member having an opening formed therein for receiving a manhole support, etc. with the cushioning device being comprised of a resilient material to cushion vehicle wheel contact. The cushioning device is secured to the roadway by means of a plurality of uniformly spaced-apart clips which are positioned about the opening. Each clip has a first portion thereof embedded within the flat resilient member and a second hook-shaped portion which operably engages the upper edge of the manhole support and manhole cover. The hook-shaped portion has a depending leg which is positioned adjacent to the inner surface of the manhole support and extends downwardly therein. The manhole cover, when returned to the manhole support, prevents the movement of the cushioning device.

DESCRIPTION OF THE PREFERRED EMBODIMENT

Figure 1:
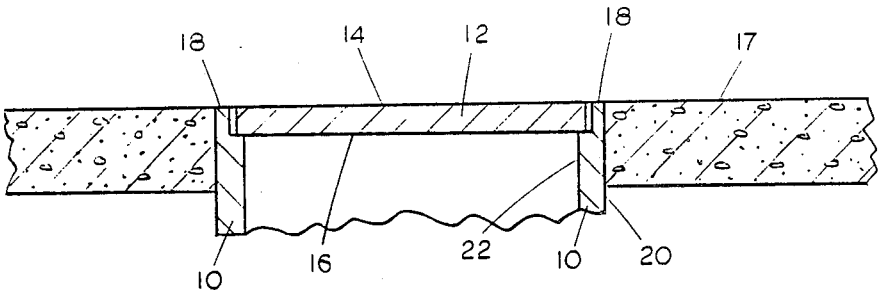
FIG. 1 is a sectional view through a street with a manhole prior to road construction.

The cushioning device of this invention is primarily intended for use in combination with a manhole support but is equally well-suited for use with a storm sewer inlet support as will be described hereinafter. In FIG. 1, the numeral 10 refers to a manhole support having manhole cover 12 positioned therein. The manhole cover includes an upper surface 14 and a lower surface 16. FIG. 1 illustrates the top surface of the road way 17 being approximately at the same plane as the upper end 18 of the manhole support 10. The manhole support 10 includes an outer surface 20 and an inner surface 22.

Figure 2:
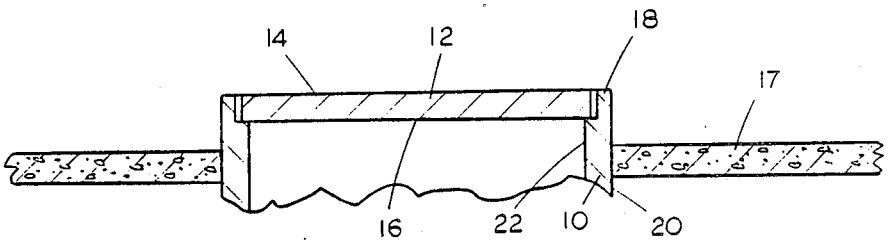
FIG. 2 is a sectional view similar to FIG. 1 but with the street surface ground away around the manhole.

FIG. 2 illustrates the relationship of the manhole support 10 after the roadway 17 has been partially ground away so that a new surface may be placed thereon. As seen in FIG. 2, the upper end 18 of the manhole support 10 dwells above the ground roadway surface 17'. Once the roadway 17 has been ground to the level as illustrated in FIG. 2, it has been heretofore necessary to erect barricades around the manhole cover 12 so that vehicles will not be damaged when they strike the exposed manhole support 10. To eliminate such a problem, a cushioning device or pad 24 is provided. Although FIG. 4 illustrates pad 24 as being approximately square, the pad could be rectangular or circular, if so desired.

Figure 3:
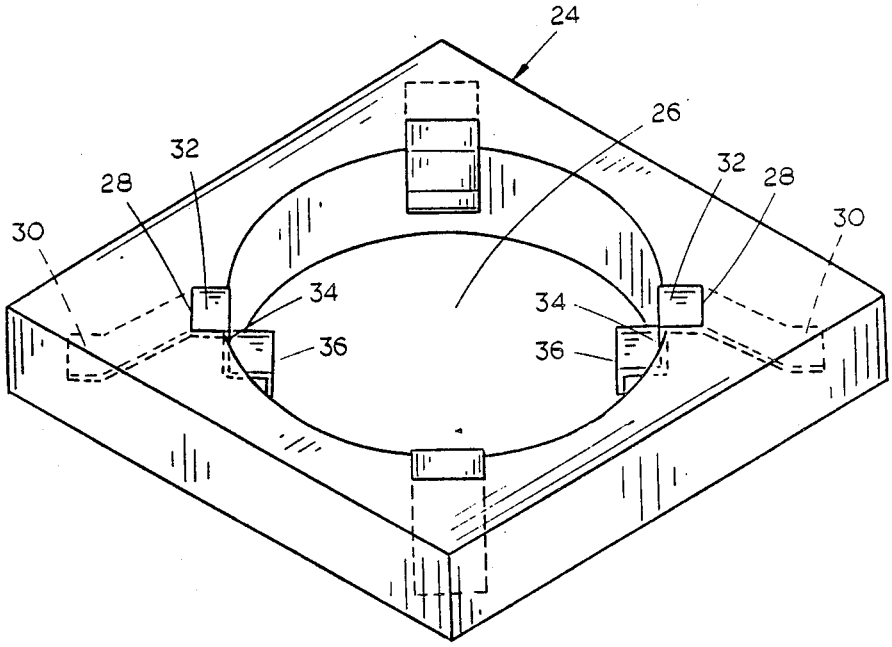
FIG. 3 is a perspective view of the device of this invention.
Figure 5:
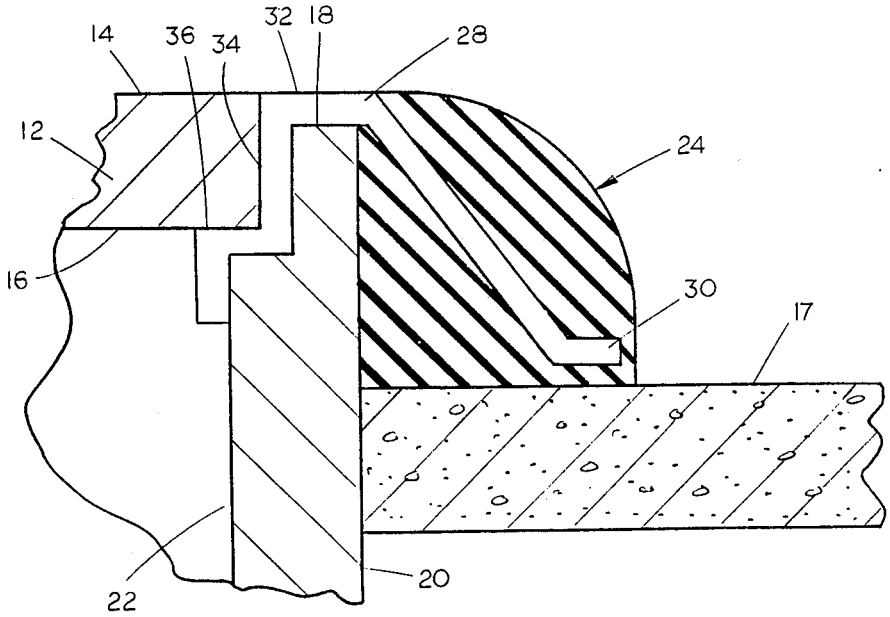
FIG. 5 is an enlarged sectional view of a portion of FIG. 4.

Pad 24 is comprised of a resilient foam material and has a central opening 26 formed therein which is adapted to receive the manhole support 10. In the preferred embodiment, pad 24 is provided with four clips 28 uniformly spaced about the central opening 26 as seen in FIG. 3, and each clip 28 is formed from spring steel or the like. The clips 28 are uniformly spaced about the structure which requires the padding so as to ensure that the device remains in the proper position when in use. Each clip 28 has a first portion 30 thereof which is embedded within the pad 24 and a second hook-shaped portion 32 which is in communication with the upper end 10 of the manhole support 10 as seen in FIG. 5. The hook-shaped portion 32 includes depending leg 34 which is spaced apart and positioned inwardly from opening 26. The depending leg 34 is positioned generally adjacent to and parallel to the inner surface 22 of manhole support 10. The leg 34 has a length slightly longer than the thickness of the manhole cover 12. This permits a tab 36 to be positioned below the lower surface 16 of the manhole cover 12 when installed. The tab 36 acts as an added safety measure to prevent the pad 24 from separating from the manhole support 10 unless the manhole cover 12 is removed. The applicant has found that where the pad 24 is of a square shape, the preferred position for the clips 28 is in alignment with a corner as seen in FIG. 3.

Figure 4:
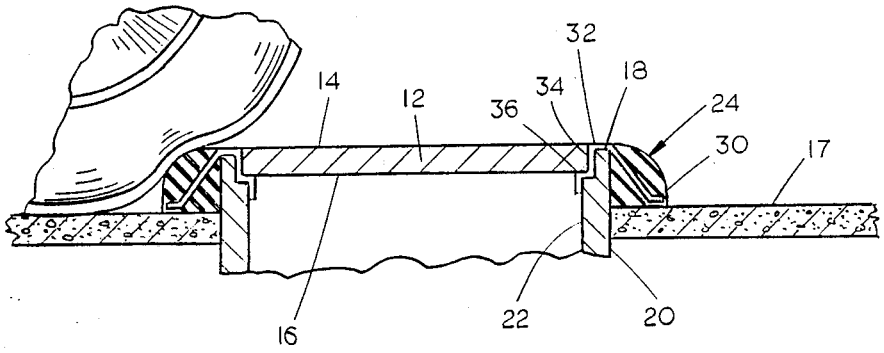
FIG. 4 is a sectional view of the invention in place around a manhole.

To eliminate the necessity of erecting barricades around the exposed manhole support 10 of FIG. 2, the manhole cover 12 is removed and the pad 24 is positioned so that opening 18 receives manhole support 10 with the second portion 32 operably engaging the manhole support 10 as seen in FIG. 4. It is preferred that the thickness of the pad 24 be substantially the same as the vertical difference between the exposed upper surface of the ground roadway 17' and the upper end of manhole support 10. Pad 24 is removably secured in position by means of the clips 28 which engage the manhole support 10 and the manhole cover 12 when the same is in position, as seen in FIG. 4. When the pad 24 is no longer needed, the manhole cover 12 is removed and the pad 24 is removed by lifting the same off.

It can be seen that the resilient pad 24 provides a ramp between the ground roadway 17' and the upper end 10' of the manhole support so that vehicles can pass over the manhole support and the manhole cover 12 without damaging the tires thereof. It can be seen that the present invention represents a significant improvement in that it is readily removable, requires no tools to install or remove, reduces the labor needed to use the device, requires no stakes and is easily manufactured.

Thus it can be seen that the present invention accomplishes at least all of its stated objectives.

I claim:

1. A temporary device for use with a manhole support positioned in a roadway which has been partially ground down for resurfacing with the grinding of the roadway causing the upper end of the manhole support to be elevated above the ground surface of the roadway, comprising, a flat, resilient temporary ramp member having a thickness approximately equal to the vertical difference between the upper end of the manhole support and the ground surface of the roadway, said ramp member having a central opening formed therein adapted to receive the manhole support therein whereby said ramp member may be temporarily positioned on the ground roadway around the manhole support to cushion contact between a vehicle wheel and the manhole support prior to the roadway being resurfaced, a plurality of clip means operatively secured to said ramp member and positioned about the central opening thereof, said clip means having a first portion embedded within said ramp member and a second portion adapted to engage the upper end of the manhole support, said clip means temporarily securing said ramp member relative to the manhole support and on the ground around said manhole support prior to resurfacing of the roadway.

2. The device of claim 1 wherein said clip means is formed from spring steel.

3. The device of claim 2 wherein said ramp member has a generally square configuration.

4. The device of claim 3 wherein four clip means are used to temporarily secure the device to the manhole support and to the ground, and each of the clip means being positioned about said opening and in alignment with a corner of said square ramp member.

5. The device of claim 1 wherein said second portion further comprises, a depending leg which is positioned inwardly and spaced apart from said opening, and a tab positioned adjacent to the lowermost edge of the depending leg and extending inwardly towards said opening.

6. In combination:

a manhole support positioned in a road which has been partially ground down for resurfacing with the grinding of the roadway causing the periphery of the manhole support to be elevated above the ground surface, said manhole support further comprising a hollow member, having an inner surface and an outer surface, a manhole cover removably positioned on said support, said manhole cover including an upper surface and a lower surface, a flat, resilient temporary ramp member having a thickness approximately equal to the vertical difference between the upper end of the manhole support and the ground surface of the roadway, said ramp member having a central opening formed therein through which said manhole support is journaled to cushion contact between a vehicle wheel and the manhole support and clip means operably securing said ramp member to said manhole support.

7. The combination of claim 6 wherein said means comprising clip means operatively secured to said ramp member and being uniformly spaced about said opening, said clip means having a first portion embedded within said ramp member and a second portion which is spaced apart from said opening and engages the upper end of the manhole support, said second portion includes a depending leg which is positioned within said manhole support and is generally adjacent to said inner surface, and said leg being operably engaged by said manhole cover when the same is in position.

8. The combination of claim 7 wherein said depending leg extends below the lower surface of said cover.

9. The combination of claim 8 wherein said depending leg further includes a tab positioned below said lower surface of said cover, such that said tab is operably engaged by the lower surface of said manhole cover when the same is in position.

10. The combination of claim 9 wherein said clip means is formed from spring steel.

11. The combination of claim 10 wherein said ramp member has a generally square configuration.

12. The combination of claim 11 wherein four clip means are used to temporarily secure the device to the manhole support and to the ground, and each of the clip means being positioned about said opening and in alignment with a corner of said square ramp member.

13. A temporary device for use with a cylindrical support positioned in a roadway which has been partially ground down for resurfacing with the grinding of the roadway causing the upper end of the cylindrical support to be elevated above the ground surface of the roadway, comprising, a flat, resilient temporary ramp member having a thickness approximately equal to the vertical distance between the upper end of the cylindrical support and the ground surface of the roadway, said ramp member having a central opening formed therein adapted to receive the cylindrical support therein whereby said ramp member may be temporarily positioned on the ground roadway around the cylindrical support to cushion contact between a vehicle wheel and the cylindrical support prior to the roadway being resurfaced, and means operatively securing said ramp member to said cylindrical support.

14. The device of claim 13 wherein said means for operatively securing the ramp member to the cylindrical support comprises a plurality of clips operatively secured to the ramp member and to the cylindrical support.

15. The device of claim 14 wherein said clips are partially imbedded in said ramp member and are held in position on the cylindrical support by a cover member received by the upper end of the cylindrical support.

* * * * *